United States Patent [19]

Griffin et al.

[11] 4,166,471

[45] Sep. 4, 1979

[54] PROSTHESIS PAD RETAINER MEANS FOR A BRASSIERE OR OTHER BREAST GARMENT

[76] Inventors: John A. Griffin; Ivon D. Griffin, both of 2769 Brouse St., Indianapolis, Ind. 46218

[21] Appl. No.: 815,296

[22] Filed: Jul. 13, 1977

[51] Int. Cl.[2] ..... A41C 3/10

[52] U.S. Cl. ..... 128/478; 128/480

[58] Field of Search ..... 128/478, 479, 461, 481, 128/462, 480; 3/36

[56] References Cited

U.S. PATENT DOCUMENTS

| | | | |
|---|---|---|---|
| 1,387,589 | 8/1921 | Bradford | 128/478 |
| 2,709,811 | 7/1955 | Cotsakis | 128/480 |
| 3,957,057 | 5/1976 | Farino | 128/478 |

FOREIGN PATENT DOCUMENTS

| | | | |
|---|---|---|---|
| 479290 | 3/1969 | Switzerland | 128/479 |

*Primary Examiner*—Doris L. Troutman

*Attorney, Agent, or Firm*—Robert A. Spray

[57] ABSTRACT

A brassiere or other garment for a female's breast area, which is provided with a retaining means primarily for a prosthesis pad following a breast mastectomy; it provides a sureness and positiveness of retention without any irregular bulk or other unattractiveness or visible hints of its special function, yet it provides comfort in the wearing, and also convenience in the insertion or removal of the prosthesis pad. Its pad-retainer panel is easily attached to other brassieres with scarcely any indication of its special use or nature; and it can convert any brassiere or breast garment to this special use, without imposing any visible unattractiveness to the outside portion of the garment.

7 Claims, 11 Drawing Figures

PROSTHESIS PAD RETAINER MEANS FOR A BRASSIERE OR OTHER BREAST GARMENT

This invention relates to brassieres and other garments for the covering of a female's breast region.

Concepts of the invention, more particularly, provide either a new garment or a convenient retainer means for existing garments, particularly for the sure and positive retention of a pad known as a prosthesis pad to be worn as a false breast following a mastectomy surgery.

The concepts of the invention are particularly significant and advantageous due to the common desire of the female that her bosom and her bosom garments look particularly attractive; and a common fear and dread of breast surgery, even if desperately needed as a life-saving surgical procedure, is that of a supposed ugliness or supposed deformity which the person might fear will be noticed, either due to irregular bulk or shape of a prosthesis garment, or due to some danger of slippage of a prosthesis pad, etc.

The fear and dread of a deformed breast-appearance no doubt is the greatest fear many women may ever have, and is so overwhelmingly feared by them that they may unfortunately prolong the time before submitting to needed surgery. And whether their supposed rejection is or may be actually real or even wholly imaginary, it is supremely and terribly real to them.

Thus, although an emotional or psychological aspect may not be usually considered or regarded as particularly important in considering the nature and utility of an invention, this matter of breast surgery is and has been so long realized to be such a source of despair, gloom, despondency, and severe depression, that the need for a prosthesis breast garment devoid of unattractive factors must be realized to be a matter of particularly significant concern. This must be realized to be the true case, even though it may be difficult to fully realize it, except by the victim of such an unfortunate problem and her family.

Accordingly, concepts of the present invention provide a pad-retaining inner panel with a convenient access opening, easily stitchable to the inner side of most any brassiere or other breast-covering garment, which provides a secure pad-retention, without slippage-danger, without discomfort, and no outwardly-visible unattractiveness whatever.

The most dainty or frilly brassiere or other breast garment can be provided to be used as a prosthesis pad retainer, with no noticeable outward unattractiveness.

The concepts further provide a similarly advantageous garment for a so-called wrap-around prosthesis pad also.

The above is of an introductory and generalized nature. More specific concepts, features, and details will be more apparent from the following more-detailed description of an embodiment illustrative of the inventive concepts.

(In the description portion of this Specification, and in the Claims, it is preliminarily mentioned that there seems to be no easy way of avoiding some otherwise confusing usages of terms such as "inner" and "outer" except perhaps by repetitive use of medical terms such as "medial" or "lateral"; and, since it seems that in context there will be sufficiently clarity by the former, particularly with this preliminary note of caution, the former terminology has been chosen in contrast to the latter. That is, the words "inner" and "outer" are used herein sometimes to designate the underlying and overlying layers, that is, the skin-adjacent or outwardly-facing layers, respectively; yet in contrast, those same words are sometimes to designate the relatively medial and relatively lateral directions, that is, the direction relatively central of a person's body or the direction relatively outwardly or sideways therefrom.)

The following detailed description is supplemented by the accompanying drawings, which are somewhat schematic and diagrammatic, particularly in view of the need to show the thickness of the panels and of their folded-over-edges, and the stitching, in exaggerated form. In the drawings.

Figure 1:
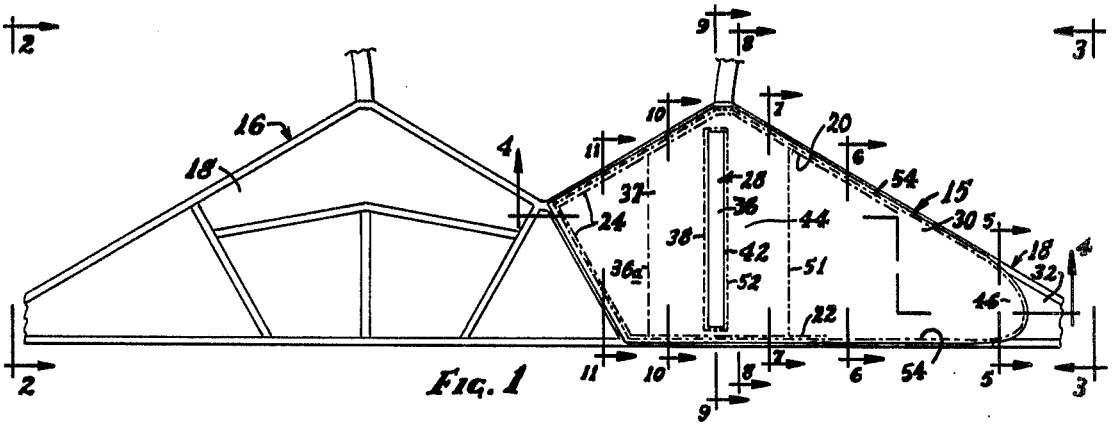
FIG. 1 is an elevational view of a brassiere having applied thereto a prosthesis-pad retainer panel onto the brassiere cup which would otherwise hold the person's right breast, the view being taken as looking outwardly onto the interior face of the brassiere.
Figure 2:
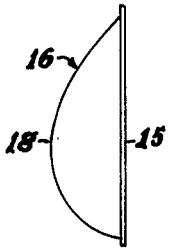
FIG. 2 is an end view of the left breast-pocket of the brassiere, taken generally along View-line 2—2 of FIG. 1.
Figure 3:
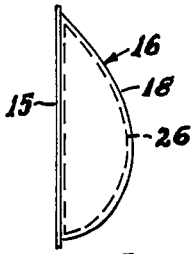
FIG. 3 is an end view of the right breast-pocket of the brassiere, having the pad-retainer installed thereon, taken generally along View-line 3—3 of FIG. 1.
Figure 4:
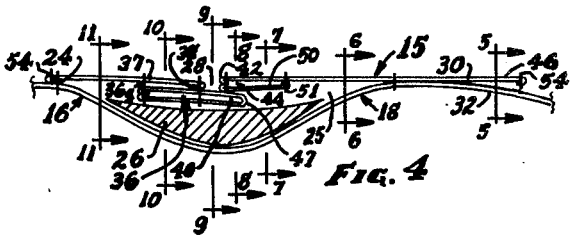
Figure 5:
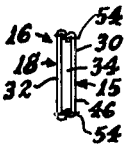
Figure 6:
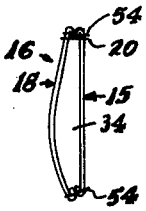
Figure 7:
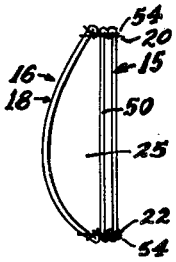
Figure 8:
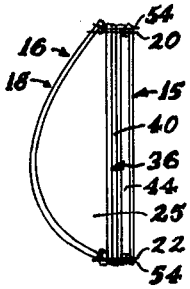
Figure 9:
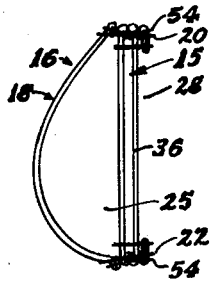
Figure 10:
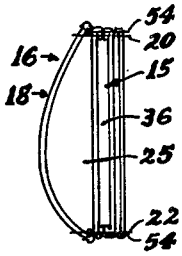
Figure 11:
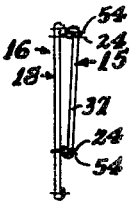

FIG. 4 is a horizontal cross-sectional view thereof, taken generally as indicated by View-line 4—4 of FIG. 1; and FIGS. 5 through 11 are vertical cross-sectional detail views thereof, respectively as taken along View-lines 5—5, 6—6, 7—7, 8—8, 9—9, 10—10, and 11—11 of FIGS. 1 and 4.

As shown in the drawings, a retainer panel means 15 is shown as applied to the right-hand portion of a brassiere 16, the brassiere 16 herein representing whatever garment for wearing about a female's bosom or breast area of her body.

Whatever garment 16 is used, it would have an outer panel means 18 of outwardly convex shape so as to overlie and receive therein the wearer's breast; and the pad-retainer 15 is herein described as an inner panel in conjunction with its application to the outer panel 18 of such a brassiere 16, for it could be used in a new garment or it could be applied to an existing garment.

In accordance with the inventive concepts, the inner or retainer panel means 15 is of generally flat shape; and it is shown a secured as at 20 and 22 along the top and bottom portions of the garment's outer panel means 18, and also secured thereto along the inner or medial portion 24 thereof.

The securing of the retainer panel 15 to the garment's breast-cup or outer panel 18 is such as to not only retain the inner panel means 15 and the outer panel means 18 in assembled relationship, but also to define or provide an enclosed pocket 25 for retaining therein the associated prosthesis pad 26.

It is to be noted as shown that the inner panel means 15 has a vertically-extending access opening 28 generally centrally thereof, of a length as much as the height of the associated prosthesis or breast pad 26, providing for insertion and removal function for the pad 26.

More particularly, the arrangement is such as to permit the prosthesis pad 26 to be slipped through the said access opening 28 into the pad-pocket 25 provided by the garment's outer panel means 18 and the inner panel or pad-retainer means 15 of the present invention.

Another particular concept is that there is provided an unsecured portion 30 of the inner panel means 15 in the region of the lateral or outer portion 32 of the outer panel means 18, providing a laterally outer opening 34 therebetween which provides two significant functions. That is, the non-secured portions 30 and 32 and opening 34 permit a wrap-around portion (not shown) of the prosthesis pad 26 to extend therethrough during wearing of the garment 16; and they also permit the outer or lateral portion of the prosthesis pad 26 to be moved sufficiently outwardly (rightwardly) during its insertion or subsequent removal from the pocket 25 that the inner or medial portion of the prosthesis pad 26 will be itself sufficiently far enough outwardly to pass through the access opening 28.

It will be noted, as shown, that the said access opening 28 of the inner panel means 15 is faced with an auxiliary panel means 36 which is secured as shown by stitching 36a to an inner or medial portion 37 of the pad-retainer panel 15 and along the inner or medial side 38 of the access opening 28; and the auxiliary panel 36 is shown to be of a horizontal width sufficient so that when it is so secured that panel 36 wholly overlies the access opening 28, and its outer portion 40 extends outwardly (rightwardly or laterally) past the outer or lateral side 42 of the access opening 28.

The outer portion 40 is non-secured to the adjacent portion 44 of the inner panel means 15, and the portion 40 thereby provides an overlying flap for the access opening 28, more fully assuring that the pad 26 will not slip out inadvertently, even though easy conscious removal is convenient.

With further reference to the non-secured portion 32 and outer opening 34, the said inner panel means 15 is shown provided with a flap-like extension 46 extending outwardly or laterally of the region of the outer or lateral portion 32 of the garment's outer panel means 18, the flap or extension 46 thereby providing an inner enclosure panel for any wrap-around outer or lateral portion (not shown) of a prosthesis pad 26 when the garment 16 is worn.

As shown best in FIG. 4, the said auxiliary panel means 36 is provided by a panel or sheet piece which is folded over onto itself along a vertical line 47 which provides a non-cut or ravel-free edge 47 for the non-secured overlying flap 40 for the said access opening 28.

Strengthening the outer central portion of the pad-retainer panel 15, and strengthening the outer edge 42 of the main or central access opening 28, there is shown secured to that panel 15 another auxiliary panel 50. That panel 50, as shown, is stitched as shown at 51 to the panel 15 rightwardly (laterally outwardly) of access opening 28, and is also stitched by stitches 52 to the outer edge 42 of access opening 28.

SUMMARY

It is thus seen that a prosthesis pad retainer means for or in assembly or attachment to a brassiere or other breast-covering female-garment, according to concepts of the present invention, provides novel and advantageous concepts and features, providing not only an effective prosthesis pad retainer means by the pocket between the retainer means and the garment's breast cup or outer panel, but does so in a manner which is scarcely if at all noticeable when viewed from the front of the garment.

Particularly advantageous for females who have had to undergo a breast mastectomy, but also useful for other reasons in which a pad is to be held in the breast location, it achieves desirable advantages of permitting the pad to be worn safely, snugly, and without slipping, yet it provides easy and convenient manual insertion and removal. It is comfortable, and gives scarcely any hint whatever of its special purpose; for it may be used with the most dainty or frilly bosom-covering garment.

Its advantages are such that hopefully it will not only lessen the emotional and psychological burden of those persons who need to use a false bosom, but that its availability and overall advantage will actually be some encouragement or incentive to those persons whose emotional dread and despondency has so far caused them to resist what for them might be life-saving and life-prolonging surgery.

Accordingly, it will thus be seen from the foregoing description of the invention according to this illustrative embodiment, considered with the accompanying drawings, that the present invention provides a new and useful prosthesis pad retainer means for otherwise conventional bosom-covering garments, which achieves desirable goals not only of construction and concept but also very substantial and significant emotional and psychological goals, the invention having desired advantages and characteristics, and accomplishing its intended objects, including those hereinbefore pointed out and others which are inherent in the invention.

Modifications and variations may be effected without departing from the scope of the novel concepts of the invention; accordingly, the invention is not limited to the specific form or arrangement of parts herein described or shown for illustration of the inventive concepts. For example, instead of being supplied separately of the garment 16, all of the members of the inner panel assembly 15 being held as a unit as by the peripheral stitching 54, it could be made as an integral or original part of the garment 16.

What is claimed is:

1. A brassiere or other garment for wearing about a female's breast area of her body, having an outer panel means of outwardly convex shape so as to overlie and receive therein the wearer's breast:

the garment having also an inner panel means of generally flat shape;

the inner panel means being secured along the top and bottom portions of the outer panel means, and also secured thereto along the inner or medial portion thereof;

the said securing being such as to not only retain the inner panel means and the outer panel means in assembled relationship but also to define or provide an enclosed pocket for retaining therein a prosthesis pad;

the inner panel means having a vertically-extending access opening generally centrally thereof, of a length as much as the height of the prosthesis pad, the arrangement being such as to permit the prosthesis pad to be slipped through the said access opening into the said pocket provided by the outer panel means and inner panel means;

in a combination in which there is provided an unsecured portion of the inner panel means in the region of the outer portion of the outer panel means, providing an outer opening therebetween which provides the double function of (a) permitting a wrap-around portion of the prosthesis pad to extend therethrough during wearing of the garment, and (b) permitting the outer portion of the prosthesis pad to be moved sufficiently outwardly during its said insertion or subsequent removal from the pocket provided by the inner panel means and outer panel means so that the inner portion of the prosthesis pad will be sufficiently far enough outwardly to pass through the said generally central vertically-extending access opening.

2. The invention as set forth in claim 1 in a combination in which the said generally central vertically-extending access opening of the inner panel means is faced with an auxiliary panel means, secured along the inner or medial side of said opening, and of a horizontal width sufficient so that when so secured it wholly overlies the said opening and extends outwardly past the outer or lateral side of said opening;

the auxiliary panel means' outer portion being non-secured to the adjacent portion of the inner panel means outwardly of said access opening and providing an overlying flap therefor.

3. The invention as set forth in claim 1 in a combination in which the said inner panel means is provided with an extension extending outwardly or laterally of the region of the outer or lateral portion of the outer panel means, thereby providing an inner enclosure panel for any wrap-around outer or lateral portion of a prosthesis pad when the garment is worn.

4. The invention as set forth in claim 2 in a combination in which the said inner panel means is provided with an extension extending outwardly or laterally of the region of the outer or lateral portion of the outer panel means, thereby providing an inner enclosure panel for any wrap-around outer or lateral portion of a prosthesis pad when the garment is worn.

5. A brassiere or other garment for wearing about a female's breast area of her body, having an outer panel means of outwardly convex shape so as to overlie and receive therein the wearer's breast:

the garment having also an inner panel means of generally flat shape;

the inner panel means being secured along the top and bottom portions of the outer panel means, and also secured thereto along the inner or medial portion thereof;

the said securing being such as to not only retain the inner panel means and the outer panel means in assembled relationship but also to define or provide an enclosed pocket for retaining therein a prosthesis pad;

the inner panel means having a vertically-extending access opening generally centrally thereof, of a length as much as the height of the prosthesis pad;

the arrangement being such as to permit the prosthesis pad to be slipped through the said access opening into the said pocket provided by the outer panel means and inner panel means;

and in which garment the said generally central vertically-extending access opening of the inner panel means is faced with an auxiliary panel means, secured along the inner or medial side of said opening, and of a horizontal width sufficient so that when so secured it wholly overlies the said opening and extends outwardly past the outer or lateral side of said opening;

the auxiliary panel means' outer portion being non-secured to the adjacent portion of the inner panel means outwardly of said access opening and providing an overlying flap therefor;

in a combination in which the said auxiliary panel means is provided by a panel means which is folded over onto itself along a vertical line which provides a non-cut edge for the non-secured overlying flap for the said vertically-extending generally central access opening.

6. The invention as set forth in claim 2 in a combination in which the said auxiliary panel means is provided by a panel means which is folded over onto itself along a vertical line which provides a non-cut edge for the non-secured overlying flap for the said vertically-extending generally central access opening.

7. The invention as set forth in claim 4 in a combination in which the said auxiliary panel means is provided by a panel means which is folded over onto itself along a vertical line which provides a non-cut edge for the non-secured overlying flap for the said vertically-extending generally central access opening.

* * * * *